US006147450A

United States Patent [19]

Fritz et al.

[11] Patent Number: 6,147,450

[45] Date of Patent: Nov. 14, 2000

[54] FLAT PANEL DISPLAY WITH GETTER IN AUXILIARY CHAMBER

[75] Inventors: William C. Fritz, Menlo Park; Igor L. Maslennikov, Suinnyvale; Robert M. Duboc, Jr., Menlo Park; Theodore S. Fahlen, San Jose; George B. Hopple, Palo Alto, all of Calif.

[73] Assignee: Candescent Technologies Corporation, San Jose, Calif.

[21] Appl. No.: 09/196,626

[22] Filed: Nov. 18, 1998

[51] Int. Cl.[7] ..... H01J 63/04

[52] U.S. Cl. ..... 313/495; 313/496; 445/25

[58] Field of Search ..... 445/41, 38, 29, 445/31, 23, 25; 313/495, 545, 546, 547, 579, 553, 554, 558

[56] References Cited

U.S. PATENT DOCUMENTS

| | | | |
|---|---|---|---|
| 4,317,061 | 2/1982 | Mendelsohn | 313/174 |
| 4,346,951 | 8/1982 | Caras et al. | 316/19 |
| 5,453,659 | 9/1995 | Wallace et al. | 313/495 |
| 5,635,795 | 6/1997 | Itoh et al. | 313/496 |
| 5,964,630 | 10/1999 | Slusarczuk et al. | 445/25 |
| 5,977,706 | 11/1999 | Cho et al. | 313/553 |

*Primary Examiner*—Vip Patel
*Assistant Examiner*—Matthew J. Gerike
*Attorney, Agent, or Firm*—Wagner, Murabito & Hao LLP

[57] ABSTRACT

An apparatus for removing contaminants from a display device using an auxiliary chamber, and a method for attaching the auxiliary chamber to the display device. In one embodiment, an auxiliary chamber is adapted to be coupled to a surface of a display device. The auxiliary chamber is adapted to be coupled to the surface of the display device such that contaminants within the display device can travel from the display device into the auxiliary chamber. The auxiliary chamber further includes a getter which is disposed therein. The getter is adapted to capture the contaminants once the contaminants travel from the display device into the auxiliary chamber. In so doing, the present invention eliminates the need for getter material to be placed within the active area of the display device. As a result, the present invention increases the usable amount of space available within the display device. This extra space can then be utilized by features such as, for example, additional field emitters.

36 Claims, 17 Drawing Sheets

FLAT PANEL DISPLAY WITH GETTER IN AUXILIARY CHAMBER

FIELD OF THE INVENTION

The present claimed invention relates to the field of flat panel displays. More particularly, the present claimed invention relates to an auxiliary chamber for removing contaminants from a display device.

BACKGROUND ART

Display devices such as, for example, flat panel display devices typically utilize an evacuated environment during operation. In a field emission-type display device, field emitters located on a cathode emit electrons which are directed towards respective pixel or sub-pixel regions on a faceplate. In such a device, it is imperative that the region between the faceplate and the cathode (i.e. the active environment) remain free of contaminants so that the electrons can travel unimpeded from the cathode to the faceplate. As yet another concern, if certain contaminants are present in the active environment between the cathode and the faceplate, certain features, such as the field emitters may be damaged.

With reference now to Prior Art FIG. 1, a side sectional view of a display device 100 employing a conventional contaminant reduction approach is shown. Specifically, Prior Art FIG. 1 shows a backplate or cathode 102 secured to a faceplate 104 via a sealing frame 106. The active environment is the region located between cathode 102 and faceplate 104. Field emitters, typically shown as 108, are coupled to cathode 102 and are disposed within the active environment. In the conventional approach of Prior Art FIG. 1, a getter material 110 is also coupled to the cathode and is disposed within the active environment. The getter material is intended to capture contaminant particles which remain in the active environment after an evacuation process. The getter material is also intended to capture contaminant particles which are generated during operation of display device 100.

Unfortunately, the conventional approach of Prior Art FIG. 1 has significant drawbacks associated therewith. By locating getter material 110 within the active environment, region 112 is no longer available for use. That is, such a prior art approach reduces or compromises the amount of space which is available to be utilized by features such as, for example, field emitters. Additionally, by placing getter material 110 within the active environment, such a prior art approach deleteriously subjects the active environment, and hence field emitters 108, to the hazardous getter material 110. As a result, field emitters 108 are often degraded or damaged due to their close proximity to getter material 110.

With reference now to Prior Art FIG. 2, a side sectional view of display device 100 employing another conventional approach in an attempt to reduce contaminants is shown. In this approach a pump-out tube is coupled directly to the active environment. The pump-out tube is used to facilitate evacuation of display device 100, and, hence, remove contaminants therefrom. Once again, such a conventional approach has severe drawbacks associated therewith. Attaching tubulation directly to the active environment of display device 100 greatly complicates the process of manufacturing display device 100. Additionally, the increased complexity associated with attaching the tubulation directly to display device 100 adds additional cost to the manufacturing process. Furthermore, the potential for defects in display device 100 is heightened by attaching tubulation 114 directly to display device 100.

Referring still to Prior Art FIG. 2, conventional tubulation such as tubulation 114 significantly alters and increase the "envelope" of display device 100. The envelope of display device 100 refers roughly to the amount of space occupied by the display device 100. In Prior Art FIG. 2, the envelope of display device 100 is shown by dotted line 116. As a result of protruding tubulation 114, display device 100 must be allotted a larger area in which to operate. It will be seen from Prior Art FIG. 2, the increased area or envelope 116 required by tubulation 114 may restrict or limit the locations and environments in which display device 100 can be used.

With reference next to Prior Art FIG. 3, a side sectional view of display device 100 employing another conventional approach in an attempt to reduce contaminants is shown. In this conventional approach, tubulation 118 is again attached directly to the active environment of display device 100. As still another drawback, tubulation 118 extends beyond the edge of display device. As result, prior art tubulation 118 often interferes with the sealing process used to secure cathode 102 and faceplate 104 together. More specifically, during a laser sealing process, for example, the laser beam or beams must contact the entire periphery of display device 100. In the configuration shown in Prior Art FIG. 3, tubulation 118 can obstruct the laser beam or beams, thereby "shadowing" a portion of the periphery of display device 100. As a result, the seal between cathode 102 and faceplate 104 can be compromised, or the sealing process must be altered to accommodate tubulation 118.

Thus, a need exists for an apparatus which removes contaminants from a display device without compromising the usable amount of space available within the display device. A further need exists for an auxiliary chamber which meets the above listed needs but which does not deleteriously expose features of the display device to getter material. Still another need exists for an auxiliary chamber which meets the above-listed needs but which does not significantly increase or alter the overall dimensions of the display device.

SUMMARY OF INVENTION

The present invention provides an apparatus which removes contaminants from a display device without compromising the usable amount of space available within the display device. The present invention also provides an auxiliary chamber which realizes the above listed accomplishment and which does not deleteriously expose features of the display device to getter material. The present invention further provides an auxiliary chamber which achieves the above-listed accomplishments but which does not significantly increase or alter the overall dimensions of the display device.

Specifically, the present invention provides an apparatus for removing contaminants from a display device using an auxiliary chamber, and a method for attaching the auxiliary chamber to the display device. In one embodiment, an auxiliary chamber is adapted to be coupled to a surface of a display device. The auxiliary chamber is adapted to be coupled to the surface of the display device such that contaminants within the display device can travel from the display device into the auxiliary chamber. The auxiliary chamber further includes a getter which is disposed therein. The getter is adapted to capture the contaminants once the contaminants travel from the display device into the auxiliary chamber. In so doing, the present invention eliminates the need for getter material to be placed within the active area of the display device. As a result, the present invention increases the usable amount of space available within the display device. This extra space can then be utilized by features such as, for example, additional field emitters.

In another embodiment, the present invention provides method for attaching an auxiliary chamber to a display device. In this embodiment, the present invention first conditions a surface of a display device such that a conditioned surface of the display device is generated. This conditioned surface of the display device is thereby adapted to have an auxiliary chamber bonded thereto. Next, the present invention conditions a surface of the auxiliary chamber such that a conditioned surface of the auxiliary chamber is generated. In so doing, the conditioned surface of the auxiliary chamber is adapted to be bonded to the conditioned surface of the display device. After the conditioning steps, the present invention bonds the conditioned surface of the auxiliary chamber to the conditioned surface of the display device.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrates embodiments of the invention and, together with the description, serve to explain the principles of the invention.

PRIOR ART

PRIOR ART

PRIOR ART

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 4:
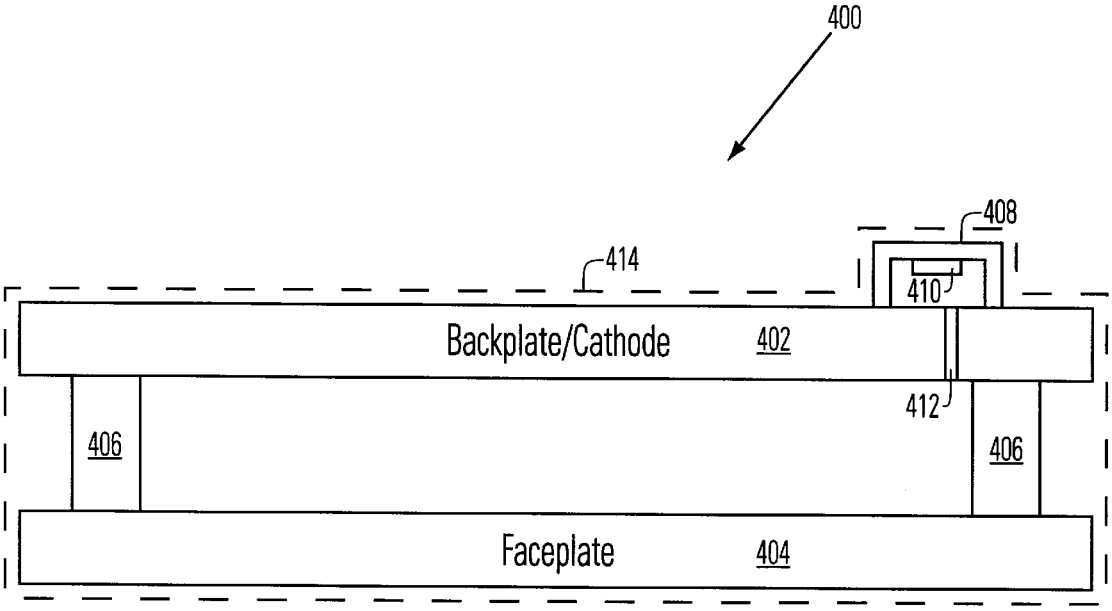
FIG. 4 is a side sectional view of a display device having an auxiliary chamber coupled thereto in accordance with one embodiment of the present claimed invention.

With reference now to FIG. 4, a side sectional view of a display device 400 having an auxiliary chamber 408 coupled thereto is shown. In the present embodiment, a backplate/cathode 402 is secured to a faceplate 404 using a sealing frame 406. Although a sealing frame is recited in the present embodiment, the present invention is also well suited to embodiments employing any of numerous methods and devices to secure cathode 402 and faceplate 404 together. Additionally, display device 400 of the present is a flat panel display device, however, the present invention is well suited for use in any device in which contaminant reduction or containment is desired. Furthermore, display device 400 of the present embodiment may contain numerous features such as, for example, field emitters, pixel regions, spacer structures, and the like, which are not shown in FIG. 4 for purposes of clarity. Also, in the present embodiment, auxiliary chamber 408 is coupled to backplate/cathode 402 of display device 400. The present invention is, however, also well suited to an embodiment in which auxiliary chamber 408 is coupled to a portion of display device 400 other than backplate/cathode 402.

Referring still to FIG. 4, an auxiliary chamber 408 is shown coupled to a surface of display device 400 in accordance with the present claimed invention. More particularly, in the embodiment of FIG. 4, auxiliary chamber 408 is coupled to the outer surface of cathode 402. Auxiliary chamber 408 of the present embodiment has a getter 410 disposed therein. Also, in the present embodiment, auxiliary chamber 408 is disposed above small openings, typically shown as 412. Openings 412 extend completely through the surface of cathode 402 to the active environment of display device 400. By placing auxiliary chamber 408 above small openings 412, contaminants within the active environment of display device 400 can travel through openings 412, into auxiliary chamber 408, and be captured by getter 410.

Figure 5:
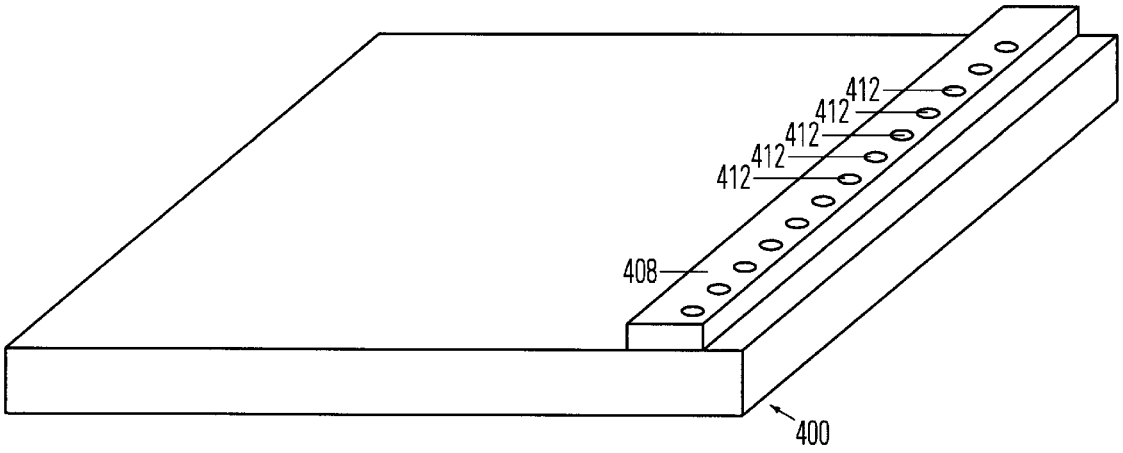
FIG. 5 is a perspective view of the embodiment of FIG. 4 in accordance with one embodiment of the present claimed invention.

With reference now to FIG. 5, a perspective view of the present embodiment is shown. In the present embodiment, auxiliary chamber 408 extends across the entire length of cathode 402 (i.e. one side to another side of cathode 402), and auxiliary chamber is disposed above a plurality of holes 412 which extend through cathode 402. Although such a configuration is shown in the present embodiment, the present invention is also well suited to various other configurations Alternate configurations include, for example, configuring auxiliary chamber 408 to extend only partially across the surface of cathode 402, configuring auxiliary chamber 408 to cover a larger portion of the surface of cathode 402, configuring auxiliary chamber 408 to cover a smaller portion of the surface of cathode 402, and the like. Additionally, the present invention is also well suited to an embodiment in which a plurality of auxiliary chambers are coupled to cathode 402.

Figure 1:
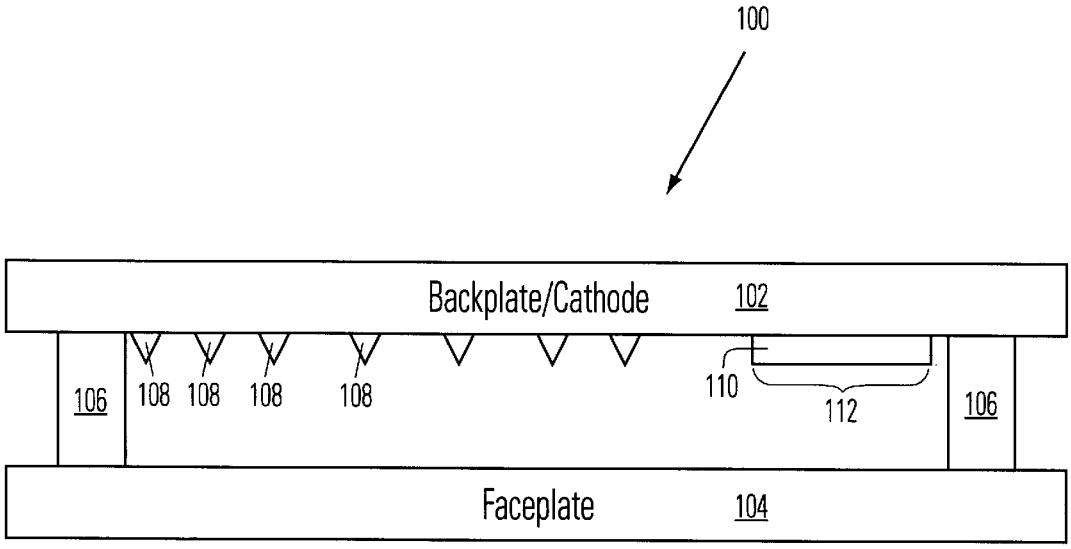
FIG. 1 (Prior Art)
FIG. 1 is a side sectional view of a display device employing a conventional contaminant reduction approach.
Figure 2:
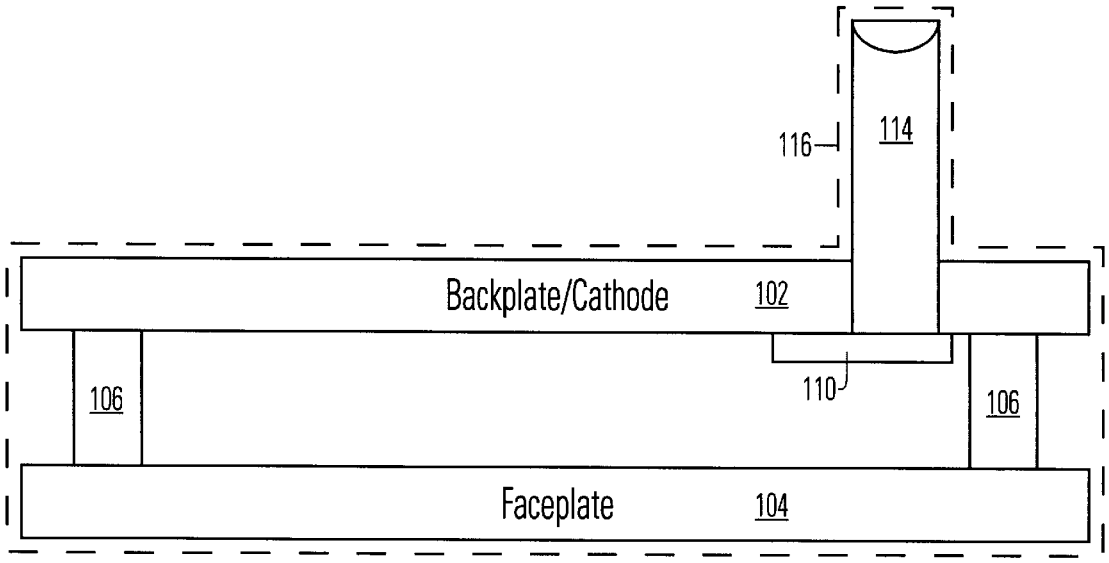
FIG. 2 (Prior Art)
FIG. 2 is a side sectional view of a display device employing another approach used in an attempt to reduce contaminants.

With reference again to FIG. 4, auxiliary chamber 408 of the present embodiment has an extremely low profile. That is, unlike prior art devices (see e.g. device 114 of Prior Art FIG. 2), auxiliary chamber 408 of the present embodiment does not significantly increase or alter the overall dimensions of display device 400. Thus, the "envelope" of display device 400 (shown by dotted line 116) is not significantly affected by the addition of auxiliary chamber 408. Therefore, unlike many conventional devices, auxiliary chamber 408 does not restrict or limit the locations and environments in which display device 400 can be used.

In the present embodiment, auxiliary chamber 408 is formed of any of various materials or combinations of material. In one embodiment, auxiliary chamber 408 is formed of glass. In another embodiment of the present invention auxiliary chamber 408 is formed of ceramic material such as, for example, alumina. Although these specific materials are recited herein, the present invention is well suited to forming auxiliary chamber out of various other materials such as metals, composites, plastics, and the like. The embodiment formed of ceramic material has several advantages associated therewith. For instance, in one embodiment when using ceramic material, auxiliary chamber 408 is formed using an extrusion process. In another embodiment when using ceramic material, auxiliary chamber 408 is formed using a molding process. In still another embodiment when using ceramic material, auxiliary chamber 408 is formed using a pressing process. In yet another embodiment when using ceramic material, auxiliary chamber 408 is formed using a lamination process. These aforementioned fabrication process greatly simplify the task of forming auxiliary chamber 408, reduce costs associated with fabricating auxiliary chamber 408, and improve the robustness of auxiliary chamber 408. Additionally, heat distribution is improved in an embodiment in which auxiliary chamber is formed of ceramic material. This improved heat distribution is particularly advantageous during a getter activation process to be described in detail below. Specifically, by readily and evenly distributing heat, a ceramic auxiliary chamber 408 is not subject to severe heat induced stresses which can occur during, for example, getter activation. Because the present invention includes both ceramic and non-ceramic embodiments, the following discussion will pertain to both the ceramic and the non-ceramic embodiments unless specifically noted otherwise.

With reference still to FIG. 4, the present embodiment disposes getter 410 within auxiliary chamber 408. Unlike conventional approaches, by locating getter 410 within auxiliary chamber, the present embodiment does not reduce or compromise the amount of space within the active environment which is available to be utilized by features such as, for example, field emitters. Furthermore, by placing getter 410 within auxiliary chamber 408, the present embodiment does not deleteriously subject the active environment, and hence the field emitters, to the hazardous getter 410. Although such an arrangement is recited in the present embodiment, the present invention is also well suited to an embodiment in which additional getter is disposed within or proximate to the active environment of display device 400.

In one embodiment, getter 410 is comprised of evaporable getter such as, for example, barium, titanium, and the like. In another embodiment, getter 410 is comprised of a non-evaporable getter. In still another embodiment, getter 410 is comprised of a combination of evaporable getter and non-evaporable getter. It will be understood that in certain embodiments of the present invention getter 410 must be activated. The present invention is well suited to accommodating any of the various getter activation processes well known in the art.

Figure 6A:
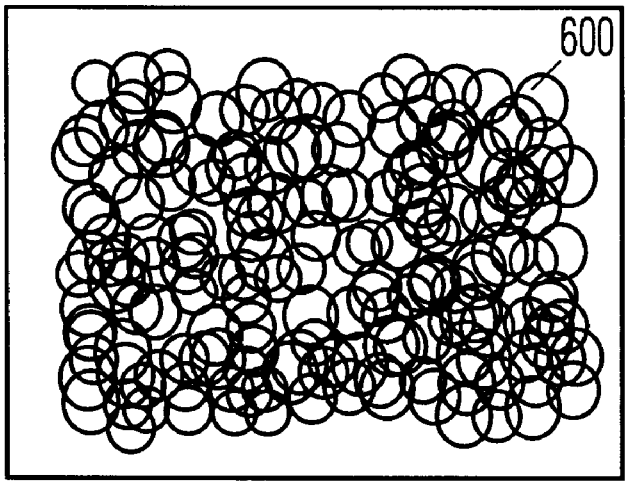
FIG. 6A is a schematic representation of getter material disposed on a bundled filament in accordance with one embodiment of the present claimed invention.

With reference now to FIG. 6A, a schematic representation of getter material disposed on a bundled filament 600 in accordance with one embodiment of the present claimed invention is shown. In this embodiment, getter material such as, for example, barium is coated on a filament. In the present embodiment, bundled filament 600 is comprised of tantalum, however, the present embodiment is also well suited to the use of various other filament materials, such as, for example, titanium, tungsten, a tantalum-titanium alloy, and the like. When exposed to heat, bundled filament 600 disperses or "flashes" or sublimates the getter material coated thereon throughout the interior surface of auxiliary chamber 408. In the present embodiment, bundled filament 600 is exposed to an rf (radio frequency) heating source, a laser heating source, and the like.

Referring still to FIG. 6A, several substantial advantages are realized by the present embodiment. When flashed or heated, bundled filament 600 disperses the getter material widely and evenly throughout the interior surface of auxiliary chamber 408. That is, many prior art approaches "throw" getter material only very near an original source of the getter material. Thus, bundled filament 600 provides a substantial disbursement improvement over conventional getter distribution methods. Bundled filament 600 is also capable of being very long and tortuous, filling the internal space of auxiliary chamber 408, and thereby containing more getter material than current getter source devices provide. Additionally, after the disbursement of the getter material, the filament remains within auxiliary chamber. The filament, along with the interior surface of auxiliary chamber 408 will have getter material dispersed thereon. The presence of the filament increases the surface area which is available to be coated with getter. Thus, gettering capabilities are enhanced in the present embodiment. Also, bundled filament 600 will heat, flash, or sublimate quickly, and distribute the heat evenly throughout the interior region of auxiliary chamber 408, thereby exposing auxiliary chamber 408 and cathode 402 to minimal thermal shock.

As yet another advantage of the embodiment of FIG. 6A, bundled filament 600 can be prepared as a subassembly and then be disposed within auxiliary chamber 408 when desired. This manufacturing flexibility provides a substantial improvement over typical prior art getter sources. Furthermore, because of its extremely low mass (and, hence, minimal heat transfer), bundled filament 600 can be located within auxiliary chamber 408 directly on the surface of cathode 402 and/or directly against the interior surface of auxiliary chamber 408. This versatility in the placement of bundled filament 600 substantially eases the burden of precise getter source mounting associated with conventional getter distribution methods.

Figure 6B:
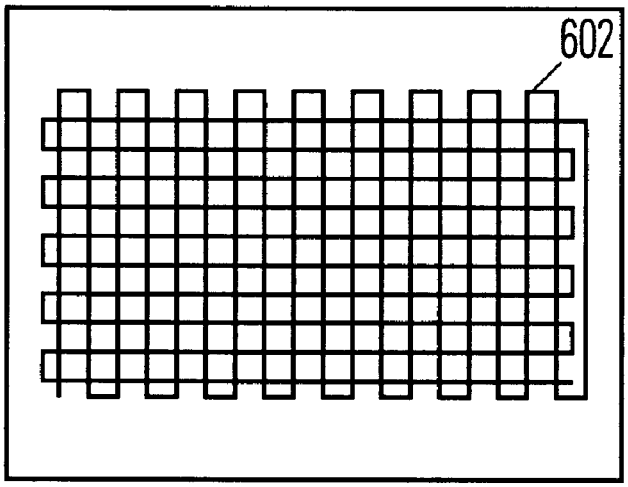
FIG. 6B is a schematic representation of getter material disposed in a filament arranged in a lattice configuration in accordance with one embodiment of the present claimed invention.

Referring now to FIG. 6B, a schematic representation of getter material disposed on a filament arranged in a lattice configuration in accordance with one embodiment of the present claimed invention is shown. The filament is arranged in a lattice configuration to produce a "latticed filament" 602 wherein the various rows and columns of the latticed filament 602 do not contact each other at respective intersections thereof. The present embodiment is formed and functions similarly to the embodiment of FIG. 6A. That is, getter material such as, for example, barium is coated on a filament. In the present embodiment, latticed filament 602 is comprised of tantalum, however, the present embodiment is also well suited to the use of various other filament materials, such as, for example, titanium, tungsten, a tantalum-titanium alloy, and the like. When exposed to heat, latticed filament 602 disperses or "flashes" the getter material coated thereon throughout the interior surface of auxiliary chamber 408. However, in the present embodiment, latticed filament 602 is adapted to be exposed to an electrical current to achieve the desired heating. To insure proper passage of current throughout its entire length, the various rows and columns of latticed filament 602 must not contact each other at respective intersections thereof. Many of the numerous substantial benefits described in conjunction with the embodiment of FIG. 6A apply to the present embodiment as well.

Figure 6C:
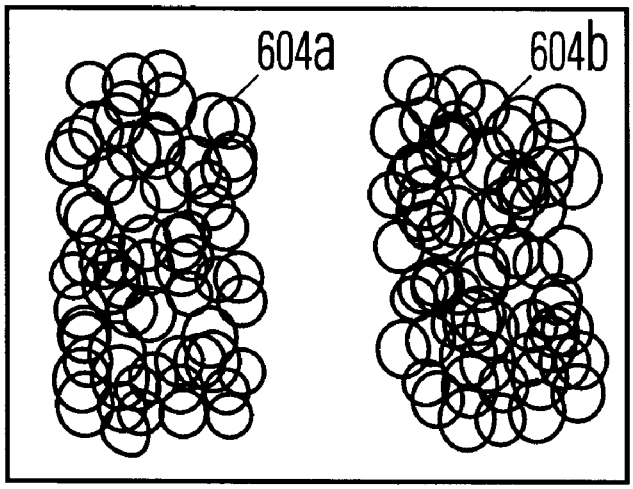
FIG. 6C is a schematic representation of getter material disposed on a plurality of separately bundled filaments in accordance with one embodiment of the present claimed invention.
Figure 6D:
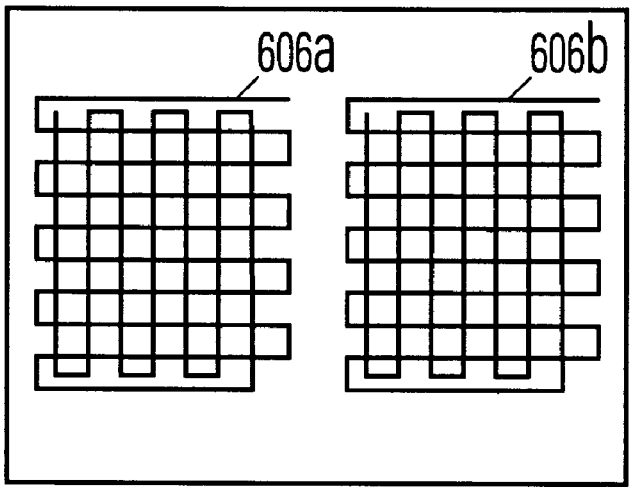
FIG. 6D is a schematic representation of getter material disposed on a plurality of filaments arranged in separate lattice configurations in accordance with one embodiment of the present claimed invention.

FIGS. 6C and 6D are schematic representations of getter material disposed on a plurality of separately bundled filaments 604*a*, 604*b*, 606*a* and 606*b*, in accordance with another embodiment of the present claimed invention. In these embodiments, multiple bundles or lattices of getter coated filaments are disposed within auxiliary chamber 408. In so doing, the distinctly partitioned filaments can be separately activated. For example, a first filament (e.g. 604*a* or 606*a*) can be activated at the factory, and a second filament (e.g. 604*b* or 606*b*) can later be activated in situ. As a result, the getter material is refreshable when desired by the customer. Although specific combination of filaments are shown in FIGS. 6C and 6D, the present invention is well suited to using a greater number of filaments in a given auxiliary chamber, and the present invention is also well suited to having a combination including both bundled and latticed filaments in the same auxiliary chamber.

With reference to FIG. 4, auxiliary chamber 408 of the present embodiment does not have tubulation extending therefrom. That is, auxiliary chamber 408 is, for example, attached to display device 400 in a vacuum environment. In such an embodiment, it may not be necessary to perform any additional evacuating processes. Thus, the present invention is well suited to an embodiment in which auxiliary device 408 does not include tubulation.

Figure 3:
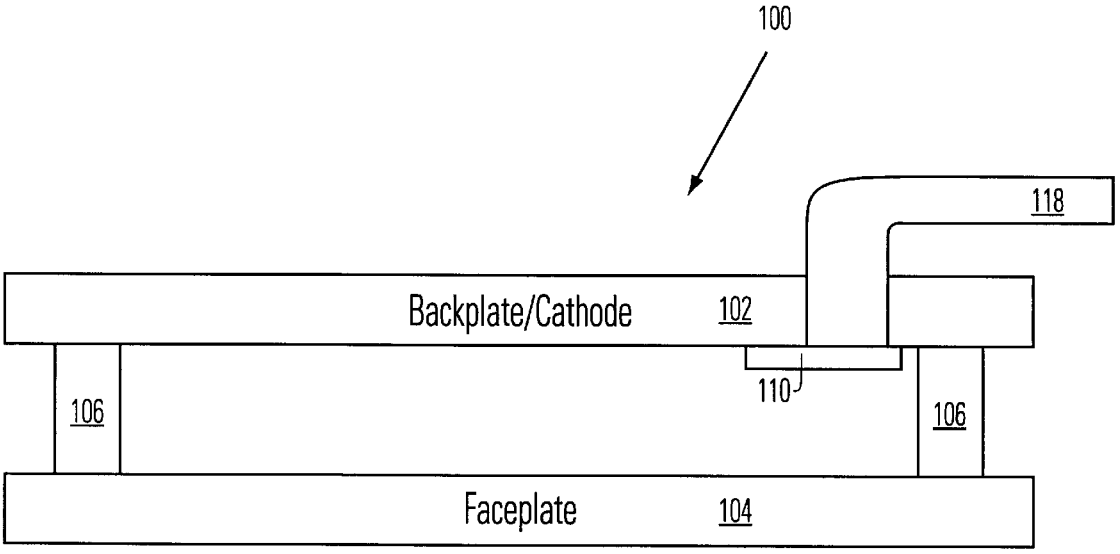
FIG. 3 (Prior Art)
FIG. 3 is a side sectional view of a display device having tubulation which protrudes beyond the edge of the display device.
Figure 7:
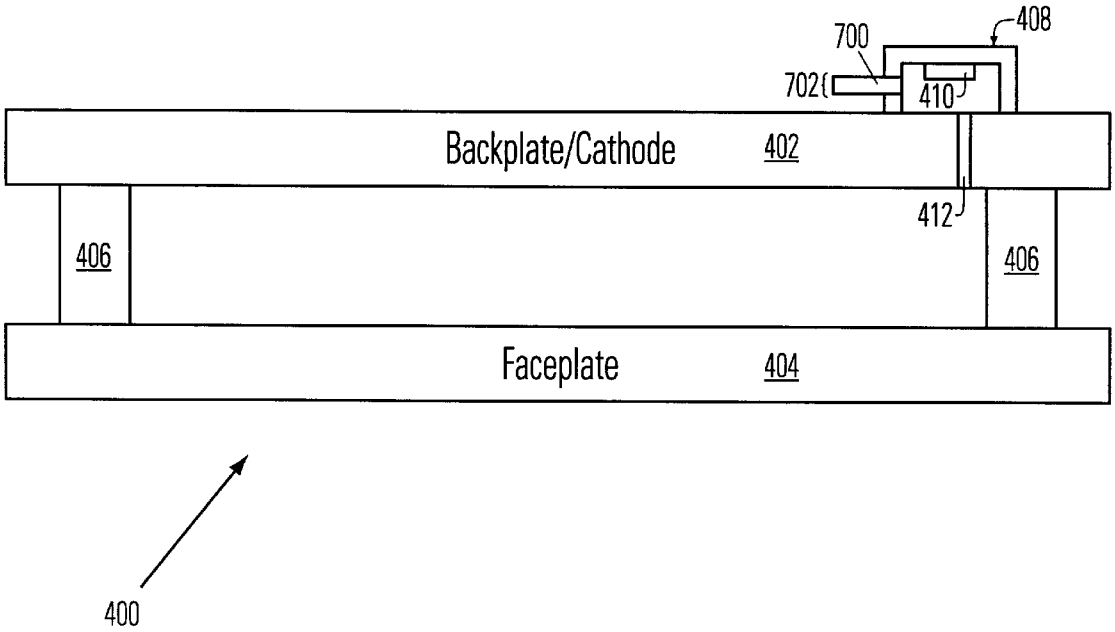
FIG. 7 is a side sectional view of a display device having an auxiliary chamber coupled thereto wherein the auxiliary chamber has tubulation projecting therefrom in accordance with one embodiment of the present claimed invention.

Referring now to FIG. 7, another embodiment of the present invention is shown. In this embodiment, auxiliary chamber 408 of FIG. 4 includes tubulation 700. Unlike conventional devices which attach tubulation directly to the active environment of the display device, tubulation 700 of the present embodiment is attached to auxiliary chamber 408. Tubulation 700 is used during a pump-out process to evacuate the active environment of display device 400 and auxiliary chamber 408. More specifically, the end 702 of tubulation 700 is coupled to a vacuum source, not shown. The vacuum source evacuates the interior of auxiliary chamber 408 and the active environment of display device 400 via tubulation 700. In the present embodiment, tubulation 700 extends from auxiliary chamber 408 such that it does not extend beyond the edge of the display device 400. More particularly, in the embodiment of FIG. 7, tubulation 700 projects "inwardly" (i.e. towards the central portion of display device 400) as opposed to projecting outwardly (i.e. directly towards a border of display device 400). Thus, unlike conventional tubulation configurations (see e.g. tubulation 118 of Prior Art FIG. 3), tubulation 700 of the present embodiment does not interfere with, for example, sealing processes used to secure cathode 402 and faceplate 404 together. Additionally, unlike conventional tubulation configurations (see e.g. tubulation 114 of Prior Art FIG. 2), tubulation 700 maintains a low profile and, thus, does not significantly alter or increase the "envelope" of display device 400. Hence, low profile, inwardly projecting tubulation 700 does not restrict or limit the locations and environments in which display device 400 can be used. The present invention is also suited to embodiments in which tubulation 700 projects other than towards the central portion of display device 400.

Referring still to FIG. 7, in the present embodiment, tubulation 700 is comprised of metal. More particularly, in the embodiment of FIG. 7, tubulation 700 is comprised of a soft metal such as, for example, nickel, copper, aluminum, and the like. Although such soft metals are recited in the present embodiment, the present invention is also well suited to the use of various other types of metals. Likewise, the present embodiment is also well suited to forming tubulation 700 of glass, ceramic, or various other non-metal materials.

With reference still to FIG. 7, several substantial advantages are achieved by forming tubulation 700 of metal. For example, metal tubulation 700 is generally stronger than glass tubulation. This increased strength improves the robustness of the manufacturing process and leads to improved yield. Also, metal tubulation is more easily manufactured and coupled to auxiliary chamber 408. For example, when auxiliary chamber 408 is formed of metal, if tubulation 700 is also formed of metal, a welding process can reliably secure tubulation 700 to auxiliary chamber 408. The present invention is also well suited to securing metal tubulation to a metal or non-metal auxiliary chamber using various other bonding procedures. For example, in an embodiment in which auxiliary chamber 408 is comprised of ceramic material and tubulation 700 is comprised of metal, tubulation 700 is well suited to being, for example, frit-sealed or brazed to ceramic auxiliary chamber 408.

Figure 8:
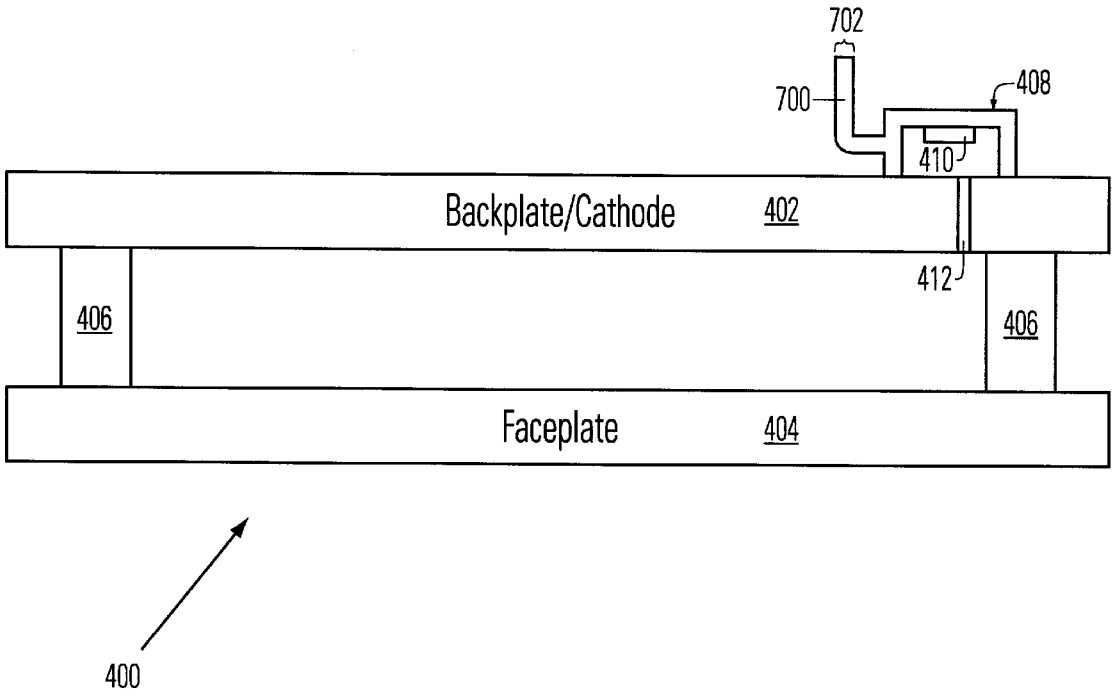
FIG. 8 is a side sectional view of a display device having an auxiliary chamber coupled thereto wherein the auxiliary chamber has bent tubulation projecting therefrom in accordance with one embodiment of the present claimed invention.

Referring now to FIG. 8, another advantage associated with forming tubulation 700 from metal is shown. In the embodiment of FIG. 8, tubulation 700 is comprised of a bendable metal. As a result, tubulation 700 is bent to facilitate coupling of end 702 of tubulation 700 to a vacuum source. Thus, despite the location and orientation of auxiliary chamber 408 tubulation 700 can be bent or configured to provide ready access for a vacuum source or other device to end 702 of tubulation 700. Furthermore, after the evacuation process, tubulation 700 can be bent to the position shown in FIG. 7. In so doing, the present embodiment maintains its low profile and, thus, does not significantly alter or increase the "envelope" of display device 400. Additionally, tubulation 700 of the present embodiment can be configured to extend beyond the edge of display device 400 to facilitate easy access to a vacuum source. However, prior to the evacuation process, tubulation 700 can be bent to ensure that tubulation 700 does not interfere with, for example, a laser sealing process. In an embodiment in which tubulation 700 is formed of glass, the glass tubulation is heated and is then bent to a desired shape.

Figure 9:
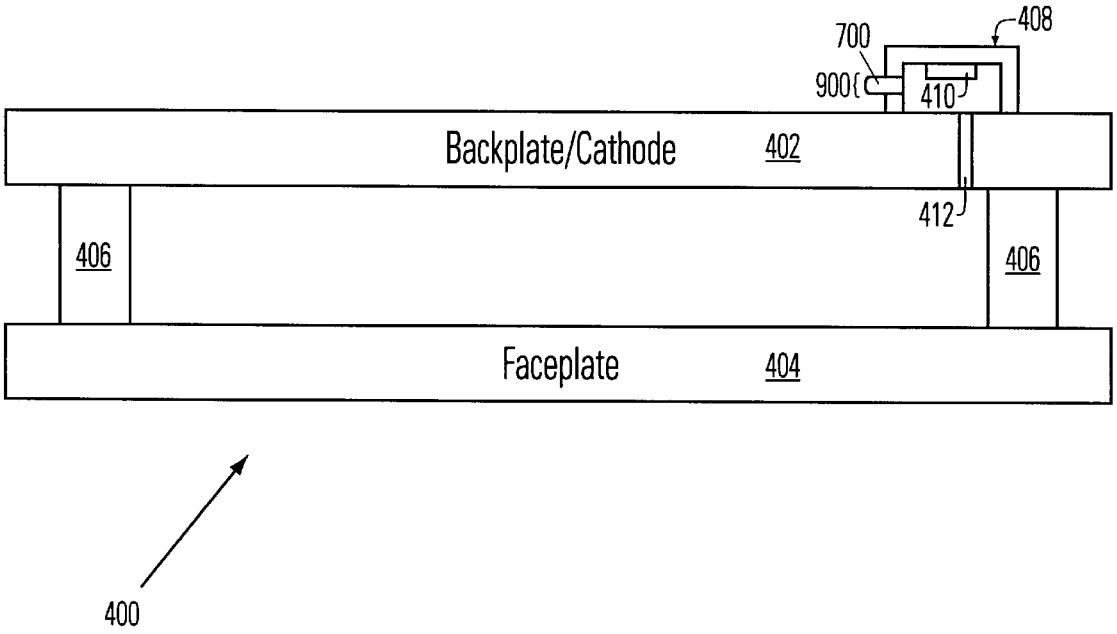
FIG. 9 is a side sectional view of a display device having an auxiliary chamber coupled thereto wherein the auxiliary chamber has sealed tubulation projecting therefrom in accordance with one embodiment of the present claimed invention.

With reference next to FIG. 9, another embodiment of the present invention is shown in which tubulation 700 extending from auxiliary chamber 408 has a sealed end 900. Typically, after a final evacuation process, the present embodiment seals tubulation 700 forming sealed end 900. In so doing, an evacuated environment is maintained within auxiliary chamber 408 and the active environment of display device 400. In the embodiments of the present invention, sealed end 900 is achieved in any of numerous ways. In an embodiment in which tubulation 700 is comprised of glass, a heating process is used to obtain sealed end 900. When tubulation 700 is comprised of metal, the present embodiment forms sealed end 900 using a non-thermal sealing process. Such a non-thermal process includes, for example, a mechanical pinching process, and the like. By using such a non-thermal sealing process, the present embodiment does not subject components of display device 400 and/or auxiliary chamber 408 to a deleterious thermal load or thermal shock. Additionally, such a mechanical sealing process results in minimal residual tubulation extending from auxiliary chamber 408.

Figure 10:
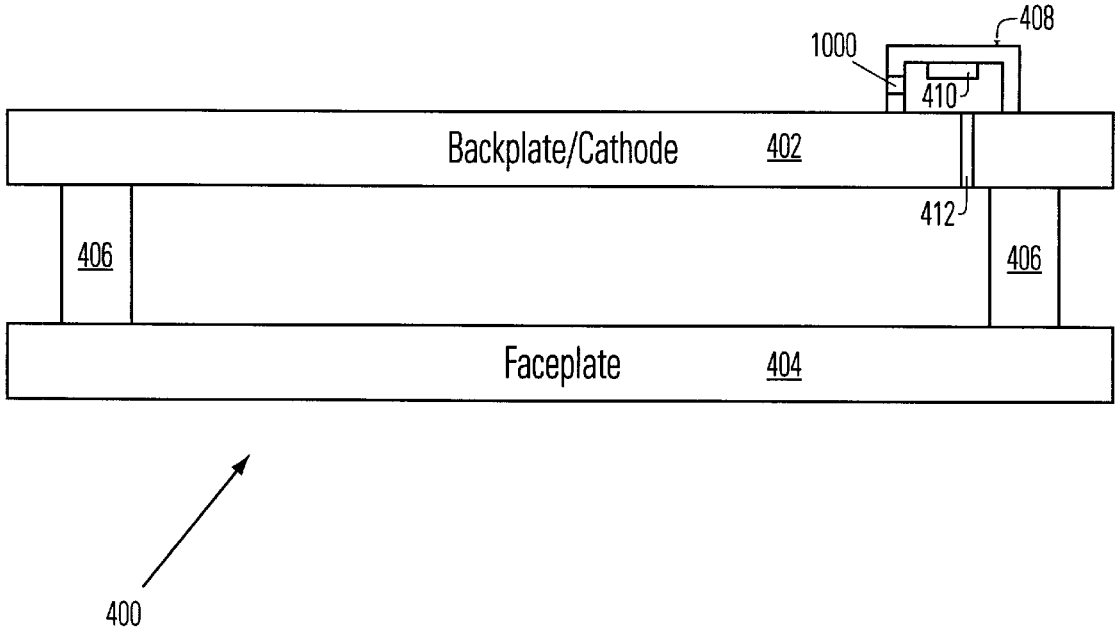
FIG. 10 is a side sectional view of a display device having an auxiliary chamber coupled thereto wherein the auxiliary chamber is plug sealed in accordance with one embodiment of the present claimed invention.

With reference now to FIG. 10, auxiliary chamber 408 of the present embodiment does not have tubulation extending therefrom. Instead, auxiliary chamber 408 is sealed using a plug seal 1000. In such an embodiment, a plug of, for example, molten quartz glass or indium is used to seal auxiliary chamber 408 after an evacuation process. As can be seen from the embodiment of FIG. 10, by using plug seal 1000, the present embodiment maintains a low profile and, thus, does not significantly alter or increase the "envelope" of display device 400. Additionally, a plug seal can be used at any location on auxiliary chamber 408. Hence, low profile, plug seal 1000 does not restrict or limit the locations and environments in which display device 400 can be used.

Figure 11:
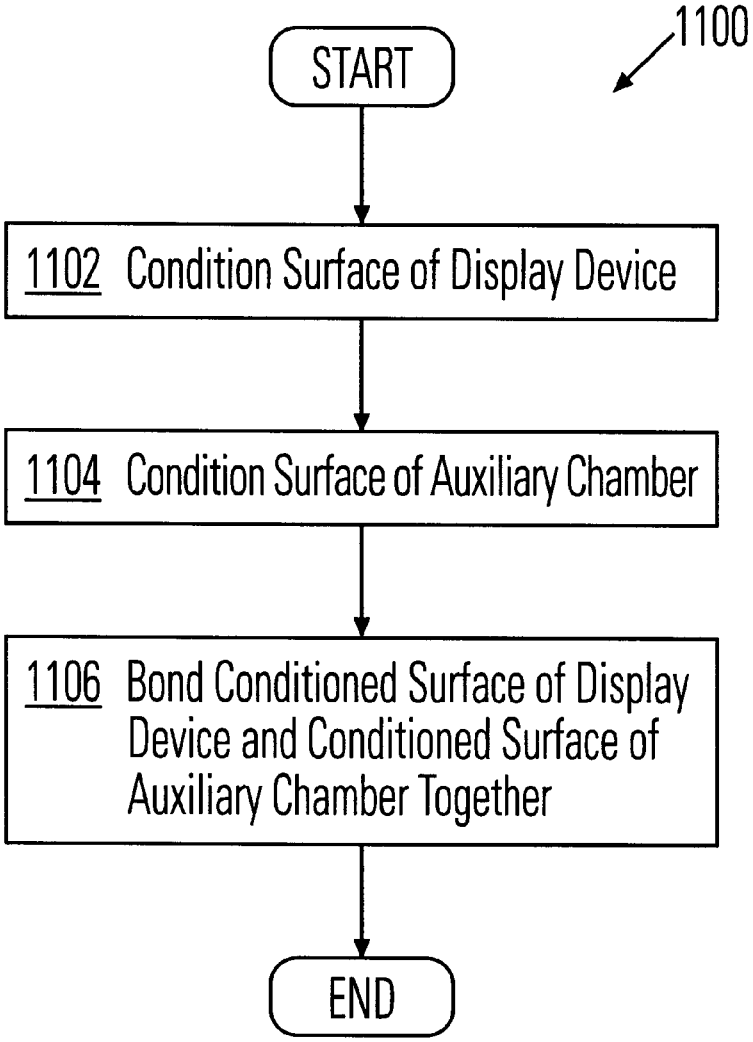
FIG. 11 is a flow chart of steps performed to attach an auxiliary chamber to surface of a display device in accordance with one embodiment of the present claimed invention.

With reference now to FIG. 11, a flow chart 1100 of steps used to attach auxiliary chamber 408 to cathode 402, both of FIGS. 4,5, and 7–10, is shown. Certain types of sealing material such as, for example, low temperature sealing frit do not bond well to smooth surfaces. That is, in certain conditions, when using such a sealing frit, the seal or bond created between two surfaces may be more mechanical then chemical. The present embodiment provides a method for attaching one smooth surface (e.g. cathode 402 or other surface of display device 400) and another smooth surface (e.g. the bottom surface of auxiliary chamber 408) together. As shown at step 1102, the present embodiment first conditions a surface of display device 400 such that a conditioned surface of display device 400 is generated. In the present embodiment, the surface of display device 400 is the top surface of cathode 402 of display device 400. In so doing, the conditioned surface of display device 400 is then adapted to have auxiliary chamber 408 bonded thereto. An embodiment of the process of step 1102 will be described in detail below in conjunction with the discussion of FIG. 12.

At step 1104, the present embodiment conditions a surface of auxiliary chamber 408 such that a conditioned surface of auxiliary chamber 408 is generated. In the present embodiment, the conditioned surface of auxiliary chamber 408 is the bottom surface of auxiliary chamber 408. In so doing, the conditioned surface of auxiliary chamber 408 is then adapted to be bonded to the conditioned surface of display device 400. An embodiment of the process of step 1104 will be described in detail below in conjunction with the discussion of FIG. 13.

Next, at step 1106, the present embodiment bonds the conditioned surface of auxiliary chamber 408 to the conditioned surface of display device 400. This, bonding step can occur, for example, in a vacuum such that no tubulation need be attached to auxiliary chamber 408. However, the present embodiment is also well suited to bonding auxiliary chamber 408 to cathode 402 in a non-vacuum environment and then evacuating auxiliary chamber 408 and the active environment of display device 400 using tubulation coupled to auxiliary chamber 408. An embodiment of the process of step 1106 will be described in detail below in conjunction with the discussion of FIG. 14. Additionally, the present invention is also well suited to an embodiment in which only the surface of display device 400 is conditioned, or only the surface of auxiliary chamber 408 is conditioned.

Figure 12:
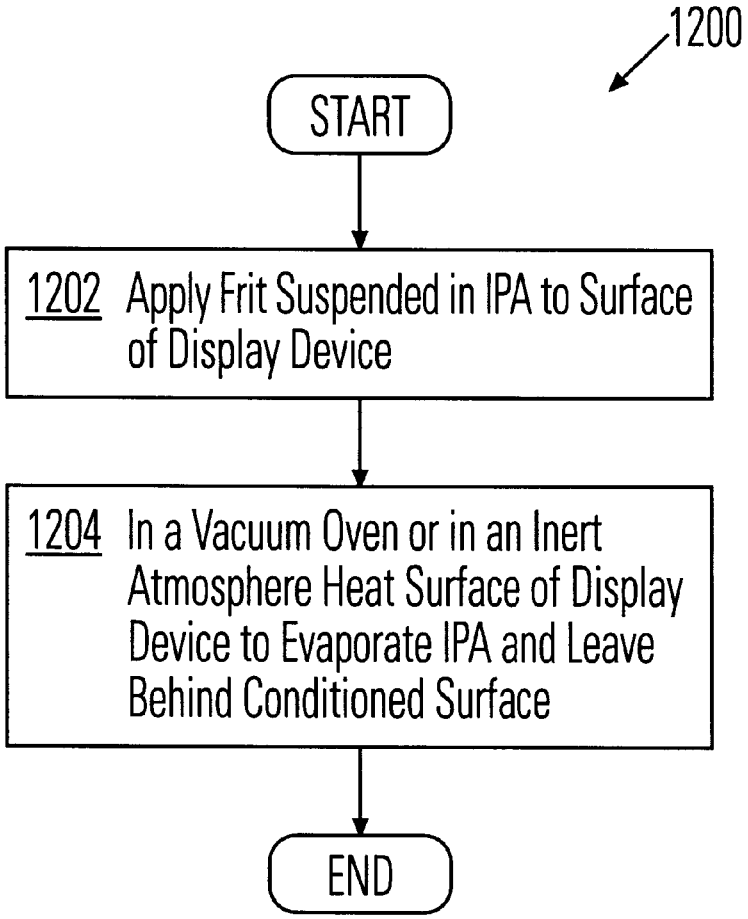
FIG. 12 is a flow chart of steps performed to condition the surface of a display device in accordance with one embodiment of the present claimed invention.

With reference now to FIG. 12, a flow chart 1200 of steps performed during conditioning of a surface of display device 400 is shown. As recited at step 1202, the present embodiment applies frit to the surface of display device 400. More particularly, at step 1202, the present embodiment applies frit without binders to the surface of display device 400. As a result, the frit can be preglazed in vacuum, not in air, so that the active elements of display device will not oxidize and are not deleteriously exposed to any binders. In one embodiment, the frit is suspended in isopropyl alcohol (IPA). The IPA containing frit therein is then, for example, "painted" onto the surface of display device 400 at the desired location.

Next, at step 1204, the surface of display device 400 is subjected to a heating step to expedite evaporation of the IPA. The evaporation of the IPA leaves a frit coating on the surface of display device 400. This heating occurs in a vacuum oven or inert atmosphere at high temperatures, thus the sensitive active elements of display device 400 are protected from any binder material. In so doing, the active elements of display device 400 are not deleteriously exposed to any binders, and the active elements of display device 400 are not deleteriously exposed to an unwanted oxygen atmosphere.

Figure 13:
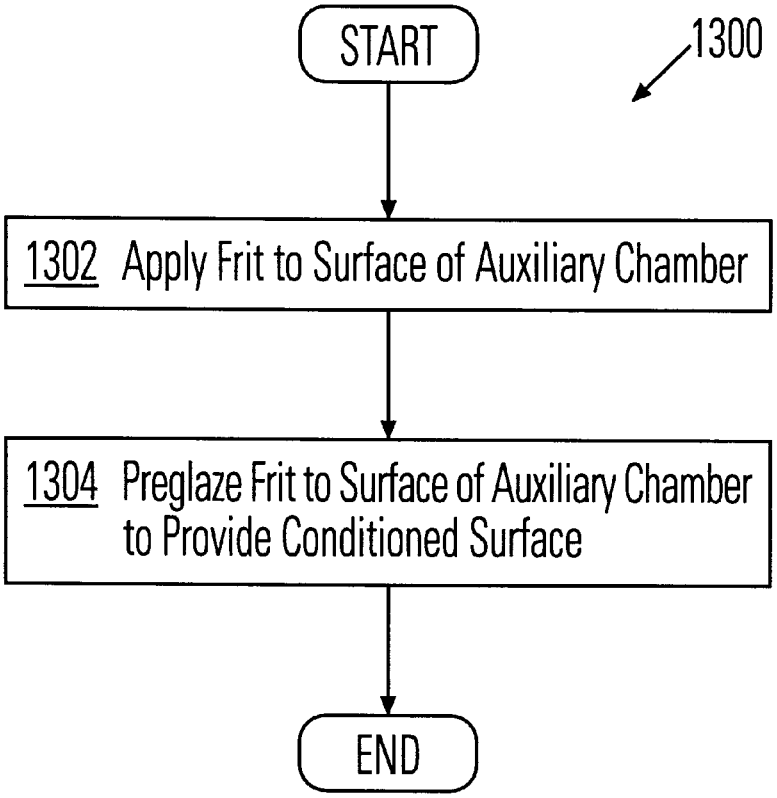
FIG. 13 is a flow chart of steps performed to condition the surface of an auxiliary chamber in accordance with one embodiment of the present claimed invention.

With reference now to FIG. 13, a flow chart 1300 of steps performed during conditioning of a surface of auxiliary chamber 408 is shown. As cited at step 1302, the present embodiment applies frit to the surface of auxiliary chamber 408. More particularly, in the present embodiment, the frit material is applied to the bottom surface of auxiliary chamber 408 where auxiliary chamber 408 will contact display device 400.

Next, at step 1304, the present embodiment preglazes the frit to the bottom surface of auxiliary chamber 408 by heating auxiliary chamber 408 such that the frit is coupled to the bottom surface thereof.

Figure 14:
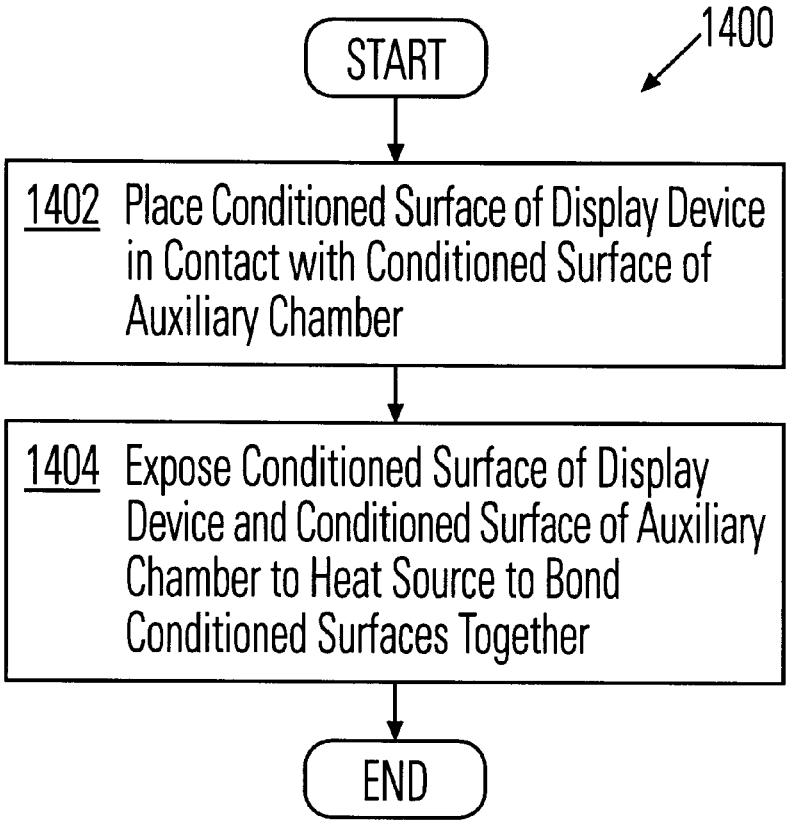
FIG. 14 is a flow chart of steps performed to bond a conditioned surface of an auxiliary chamber to a conditioned surface of a display device in accordance with one embodiment of the present claimed invention.

With reference now to FIG. 14, a flow chart 1400 of steps performed during bonding of the conditioned surface of display device 400 and the conditioned surface of auxiliary chamber 408 is shown. As recited at step 1402, the present embodiment places the conditioned surface of display device 400 and the conditioned surface of auxiliary chamber 408 in contact with each other.

Next, at step 1404, the present embodiment exposes the conditioned surface of display device 400 and the conditioned surface of auxiliary chamber 408 to a heat source such that the conditioned surface of display device 400 and the conditioned surface of auxiliary chamber 408 are bonded together. In the present embodiment, the conditioned surface of display device 400 and the conditioned surface of auxiliary chamber 408 are exposed to a laser heating source. Although such heating is recited in the present embodiment, the present invention is also well suited to exposing the conditioned surface of display device 400 and the conditioned surface of auxiliary chamber 408 to various other heating methods such as, for example, radio frequency (RF) heating, oven heating, and the like. Additionally, in one embodiment, the conditioned surface of display device 400 and the conditioned surface of auxiliary chamber 408 are exposed to the heat source in an inert environment such that the heat does not damage active elements of display device 400. In an embodiment in which a laser is used to bond display device 400 and auxiliary chamber 408 together, such bonding can be accomplished without requiring the use of a low temperature frit suspended in IPA.

Figure 15:
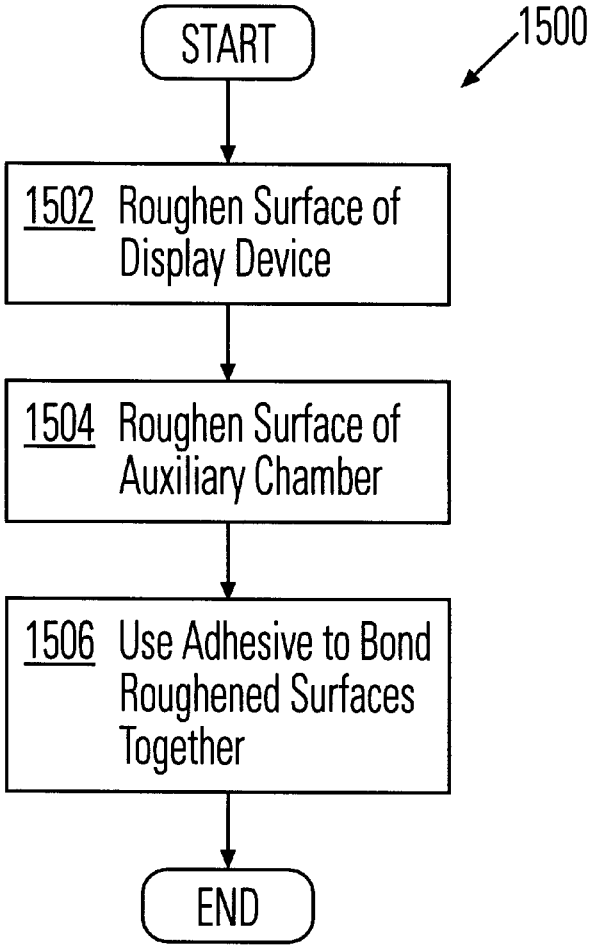
FIG. 15 is a flow chart of steps performed to attach an auxiliary chamber to surface of a display device using an adhesive in accordance with one embodiment of the present claimed invention.

With reference now to FIG. 15, a flow chart 1500 of steps performed during another embodiment of the present invention is shown. In this embodiment of the present invention, the surface of display device 400 and the surface of auxiliary chamber 408 are conditioned by a roughening process. As recited in step 1502, the surface of display device 400 is roughened using for example, a chemical process, a mechanical process, a laser process, and the like. This process is used to create topography on the surface of display device 400 wherein the topography facilitates a bonding process. In the present embodiment, the chemical roughening process includes, for example, exposing the surface of display device 400 to an acid etch process. The mechanical roughening process includes, for example, sandblasting or sanding the surface of display device 400. The laser roughening process includes, for example, exposing the surface of display device 400 to a laser to mark or pit the surface thereof.

At step 1504, the surface of auxiliary chamber 408 is roughened using for example, a chemical process, a mechanical process, a laser process, and the like. This process is used to create topography on the surface of auxiliary chamber 408 wherein the topography facilitates a bonding process. In the present embodiment, the chemical roughening process includes, for example, exposing the surface of auxiliary chamber 408 to an acid etch process. The mechanical roughening process includes, for example, sandblasting or sanding the surface of auxiliary chamber 408. The laser roughening process includes, for example, exposing the surface of auxiliary chamber 408 to a laser to mark or pit the surface thereof.

At step 1506, the present embodiment uses an adhesive to bond the roughened surface of display device 400 and the roughened surface of auxiliary chamber 408 together. The present embodiment is well suited to using any of various types of adhesive to accomplish step 1506. Additionally, the present invention is also well suited to an embodiment in which only the surface of display device 400 is roughened, or only the surface of auxiliary chamber 408 is roughened. Furthermore, the present invention is also well suited to an embodiment in which the surface of display device 400 is conditioned with frit, and the surface of auxiliary chamber 408 is roughened as described above, or surface of display device 400 is roughened as described above, and the surface of auxiliary chamber 408 is conditioned with frit.

Figure 16A:
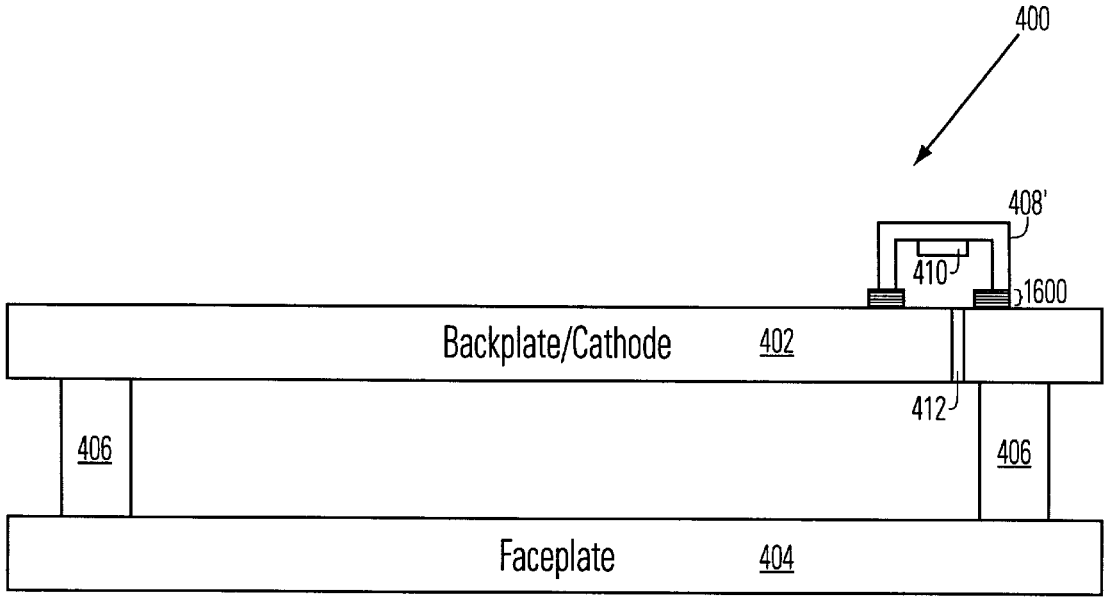
FIG. 16A is a side sectional view of a display device having an auxiliary chamber in a compressed state coupled thereto wherein the auxiliary chamber has a variable volume in accordance with one embodiment of the present claimed invention.

With reference now to FIG. 16A, another embodiment of the present invention is shown in which an auxiliary chamber 408' has a variable volume. More specifically, in the present embodiment auxiliary chamber 408' has an expandable portion 1600. In FIG. 16A, expandable portion 1600 is in a compressed state. In the present embodiment, expandable portion is comprised of a bellow-like structure, which is maintained in the compressed state during evacuation and sealing (i.e. tip-off) of display 400. As a result, the present embodiment maintains a low profile as described above in detail.

Figure 16B:
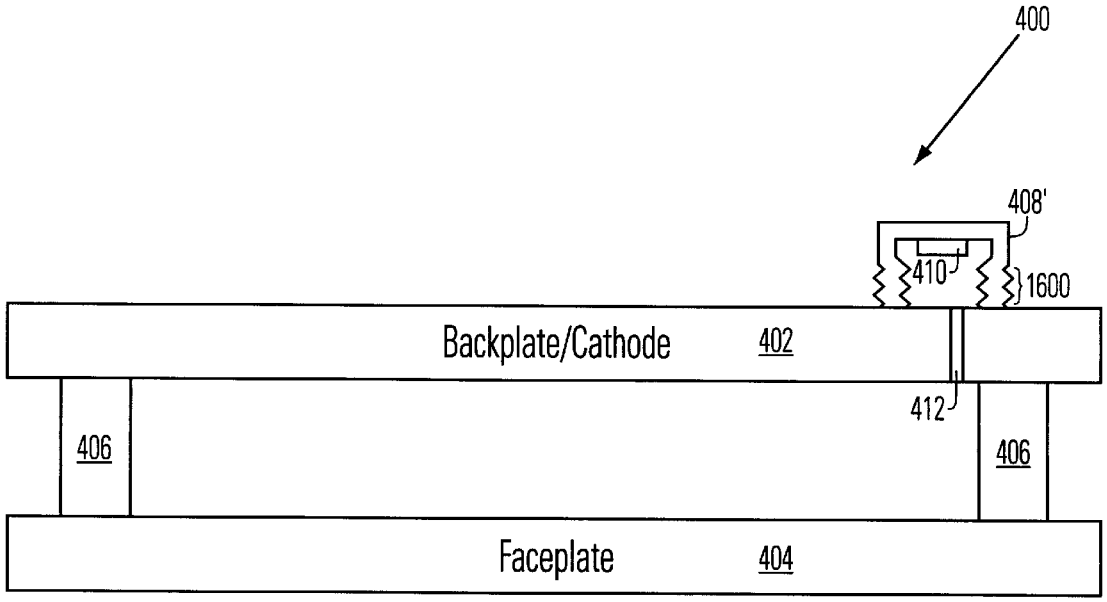
FIG. 16B is a side sectional view of a display device having an auxiliary chamber in an expanded state coupled thereto wherein the auxiliary chamber has a variable volume in accordance with one embodiment of the present claimed invention.

Referring now to FIG. 16B, auxiliary chamber 408' is shown in an expanded state. As a result, the volume of auxiliary chamber has been increased. Thus, the present embodiment provides an auxiliary chamber having a variable volume. In operation, the present embodiment is extended after evacuation and sealing (i.e. tip-off) of display 400 to increase the volume of auxiliary chamber 408'. Getter 410 is then activated (e.g. flashed), and then auxiliary chamber 408' is returned to its compressed state to return display 400 to the desired low profile. In so doing, the present embodiment increases the distance of getter 410 from the active area of the display, improves dispersion of the getter material, and, in the end, maintains the desired low-profile.

Thus, the present invention provides an apparatus which removes contaminants from a display device without compromising the usable amount of space available within the display device. The present invention also provides an auxiliary chamber which realizes the above listed accomplishment and which does not deleteriously expose features of the display device to getter material. The present invention further provides an auxiliary chamber which achieves the above-listed accomplishments but which does not significantly increase or alter the overall dimensions of the display device.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications are suited to the particular use contemplated. It is intended that the scope of the invention be defined by the claims appended hereto and their equivalents.

What is claimed is:

1. An apparatus for removing contaminants from a display device comprising:

an auxiliary chamber adapted to be coupled to a surface of a display device, said auxiliary chamber adapted to be coupled to said surface of said display device such that contaminants within said display device can travel from said display device into said auxiliary chamber; and a getter disposed on a filament located within said auxiliary chamber, said getter adapted to capture said contaminants once said contaminants travel from said display device into said auxiliary chamber.

2. The apparatus of claim 1 for removing contaminants from a display device wherein said auxiliary chamber is further adapted to be coupled to a backplate of a flat panel display device.

3. The apparatus of claim 1 for removing contaminants from a display device wherein said auxiliary chamber is further adapted to be disposed above holes extending through said surface of said display device such that said contaminants within said display device can travel from said display device through said holes and into said auxiliary chamber.

4. The apparatus of claim 1 for removing contaminants from a display device wherein said auxiliary chamber has a low profile.

5. The apparatus of claim 1 for removing contaminants from a display device wherein said getter is a non-evaporable getter.

6. The apparatus of claim 1 for removing contaminants from a display device wherein said getter is an evaporable getter.

7. The apparatus of claim 1 for removing contaminants from a display device wherein said getter is comprised of both evaporable getter and non-evaporable getter.

8. The apparatus of claim 1 for removing contaminants from a display device wherein said auxiliary chamber has a variable volume.

9. The apparatus of claim 1 for removing contaminants from a display device wherein said filament is a configured in a lattice arrangement adapted to conduct an electrical current therethrough.

10. The apparatus of claim 1 for removing contaminants from a display device wherein said filament is configured in a bundled arrangement.

11. The apparatus of claim 1 for removing contaminants from a display device wherein said getter is disposed on a plurality of separate filaments located within said auxiliary chamber.

12. The apparatus of claim 1 for removing contaminants from a display device wherein said auxiliary chamber is adapted to be plug-sealed after an evacuation of said auxiliary chamber and said display device.

13. The apparatus of claim 1 for removing contaminants from a display device further comprising:

tubulation coupled to said auxiliary chamber, said tubulation adapted to be coupled to a vacuum source during evacuation of said auxiliary chamber and said display device.

14. The apparatus of claim 13 for removing contaminants from a display device wherein said tubulation extends from said auxiliary chamber such that said tubulation does not protrude beyond the edge of said display device.

15. The apparatus of claim 13 for removing contaminants from a display device wherein said tubulation extends from said auxiliary chamber such that said tubulation is projected inwardly towards the central portion of said display.

16. The apparatus of claim 13 for removing contaminants from a display device wherein said tubulation is adapted to be sealed using a non-thermal sealing process.

17. The apparatus of claim 13 for removing contaminants from a display device wherein said tubulation is comprised of metal.

18. The apparatus of claim 13 for removing contaminants from a display device wherein said tubulation is comprised of glass.

19. The apparatus of claim 1 for removing contaminants from a display device wherein said auxiliary chamber has a variable volume.

20. An apparatus for removing contaminants from a display device comprising:

a ceramic auxiliary chamber adapted to be coupled to a surface of a display device, said ceramic auxiliary chamber adapted to be coupled to said surface of said display device such that contaminants within said display device can travel from said display device into said ceramic auxiliary chamber; and a getter disposed on a filament within said ceramic auxiliary chamber, said getter adapted to capture said contaminants once said contaminants travel from said display device into said ceramic auxiliary chamber.

21. The apparatus of claim 20 for removing contaminants from a display device wherein said ceramic auxiliary chamber is further adapted to be coupled to a backplate of a flat panel display device.

22. The apparatus of claim 20 for removing contaminants from a display device wherein said ceramic auxiliary chamber is further adapted to be disposed above holes extending through said surface of said display device such that said contaminants within said display device can travel from said display device through said holes and into said ceramic auxiliary chamber.

23. The apparatus of claim 20 for removing contaminants from a display device wherein said ceramic auxiliary chamber has a low profile.

24. The apparatus of claim 20 for removing contaminants from a display device wherein said getter is a non-evaporable getter.

25. The apparatus of claim 20 for removing contaminants from a display device wherein said getter is an evaporable getter.

26. The apparatus of claim 20 for removing contaminants from a display device wherein said getter is comprised of both evaporable getter and non-evaporable getter.

27. The apparatus of claim 20 for removing contaminants from a display device wherein said filament is a configured in a lattice arrangement adapted to conduct an electrical current therethrough.

28. The apparatus of claim 20 for removing contaminants from a display device wherein said filament is a configured in a bundled arrangement.

29. The apparatus of claim 20 for removing contaminants from a display device wherein said getter is disposed on a plurality of separate filaments located within said ceramic auxiliary chamber.

30. The apparatus of claim 20 for removing contaminants from a display device wherein said ceramic auxiliary chamber is adapted to be plug-sealed after an evacuation of said ceramic auxiliary chamber and said display device.

31. The apparatus of claim 20 for removing contaminants from a display device further comprising:

tubulation coupled to said ceramic auxiliary chamber, said tubulation adapted to be coupled to a vacuum source during evacuation of said ceramic auxiliary chamber and said display device.

32. The apparatus of claim 31 for removing contaminants from a display device wherein said tubulation extends from said ceramic auxiliary chamber such that said tubulation does not protrude beyond the edge of said display device.

33. The apparatus of claim 31 for removing contaminants from a display device wherein said tubulation is extends from said ceramic auxiliary chamber such that said tubulation is projected inwardly towards the central portion of said display.

34. The apparatus of claim 31 for removing contaminants from a display device wherein said tubulation is adapted to be sealed using a non-thermal sealing process.

35. The apparatus of claim 31 for removing contaminants from a display device wherein said tubulation is comprised of metal.

36. The apparatus of claim 31 for removing contaminants from a display device wherein said tubulation is comprised of glass.

* * * * *

UNITED STATES PATENT AND TRADEMARK OFFICE
CERTIFICATE OF CORRECTION

PATENT NO : 6,147,450
DATED : 11/14/00
INVENTOR(S) : William C. Fritz, Igor L. Maslennikov, Robert M. Duboc, Jr., Theodore S. Fahlen and George B. Hopple

It is certified that error appears in the above-identified patent and that said Letters Patent are hereby corrected as shown below:

Title page, Item [75], Inventors

Igor L. Maslennikov, Sunnyvale

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*